US006796450B2

(12) United States Patent
Prevot et al.

(10) Patent No.: US 6,796,450 B2
(45) Date of Patent: Sep. 28, 2004

(54) HOT FILLABLE CONTAINER HAVING SEPARATE RIGID GRIPS AND FLEX PANELS

(75) Inventors: Roger M. Prevot, Felton, PA (US); David M. Melrose, Auckland (NZ); Richard K. Ogg, Littlestown, PA (US); Raymond A. Pritchett, Red Lion, PA (US)

(73) Assignee: Graham Packaging Company, L.P., York, PA (US)

( * ) Notice: Subject to any disclaimer, the term of this patent is extended or adjusted under 35 U.S.C. 154(b) by 0 days.

(21) Appl. No.: 10/182,165

(22) Filed: Jul. 25, 2002

(65) Prior Publication Data

US 2003/0205550 A1 Nov. 6, 2003

Related U.S. Application Data

(60) Provisional application No. PCT/US01/32217, filed on Oct. 17, 2001, and provisional application No. 60/241,734, filed on Oct. 19, 2000.

(51) Int. Cl.[7] ..... B65D 90/02

(52) U.S. Cl. ..... 215/381; 215/384

(58) Field of Search ..... 215/381, 384; D9/359, 543

(56) References Cited

U.S. PATENT DOCUMENTS

| | | | | |
|---|---|---|---|---|
| 3,537,498 | A | | 11/1970 | Amand |
| D258,346 | S | * | 2/1981 | Winchell et al. ..... D9/520 |
| D261,106 | S | * | 10/1981 | Winchell et al. ..... D9/542 |
| 5,141,120 | A | | 8/1992 | Brown et al. |
| 5,141,121 | A | | 8/1992 | Brown et al. |
| 5,226,550 | A | | 7/1993 | Mikolaitis et al. |
| 5,279,433 | A | | 1/1994 | Krishnakumar et al. |
| D344,457 | S | | 2/1994 | Prevot et al. |
| 5,392,937 | A | | 2/1995 | Prevot et al. |
| 5,472,105 | A | | 12/1995 | Krishnakumar et al. |
| 5,598,941 | A | | 2/1997 | Semersky et al. |
| D420,593 | S | | 2/2000 | Denner et al. |
| D423,936 | S | | 5/2000 | Smith et al. |
| D428,815 | S | | 8/2000 | Mooney et al. |
| D448,674 | S | | 10/2001 | Mooney |
| D450,595 | S | * | 11/2001 | Ogg et al. ..... D9/537 |
| 6,375,025 | B1 | | 4/2002 | Mooney |
| 6,390,316 | B1 | | 5/2002 | Mooney |

FOREIGN PATENT DOCUMENTS

| | | |
|---|---|---|
| WO | WO 00/50309 | 8/2000 |

* cited by examiner

*Primary Examiner*—T. Mai
(74) *Attorney, Agent, or Firm*—Howson and Howson

(57) ABSTRACT

A lightweight hot-fill blow-molded plastic container (10, 110) having a sidewall (16) with a rigid grip portion (24, 124) and a flexible vacuum absorption portion (26, 126).

15 Claims, 4 Drawing Sheets

10
12
2
22a
24
24a
24b
16
18
20
20
28b
Cg
28a
3
3
24c
16b
16a
18
30
18
20
4
4
26
26a
14
2

110
122a
124b
124c
124
Cg
116b
130
134
126
138
126
136
114

HOT FILLABLE CONTAINER HAVING SEPARATE RIGID GRIPS AND FLEX PANELS

CROSS REFERENCE TO RELATED APPLICATIONS

This application is a 371 of PCT/US01/32217 which was filed on Oct. 17, 2001 and which claims the benefit of priority of U.S. Provisional Patent Application No. 60/241,734 filed on Oct. 19, 2000.

FIELD OF THE INVENTION

The present invention relates to hot-fill blow-molded plastic containers, and more particularly, the present invention relates to hot-fill blow-molded plastic containers having opposed grips affording facile handling of the container by the consumer.

BACKGROUND OF THE INVENTION

In the early 1990s, Graham Packaging Company pioneered the commercialization of hot-fill blow-molded plastic containers having sidewalls with elongate flex panels that incorporated grip structures. These containers are the subject of U.S. Pat. Nos. 5,392,937 and D.344,457. In the patented containers, the grip structure moves with the vacuum panel in response to vacuum induced inside the container in response to hot filling, capping and cooling of the container contents. While the patented Graham containers have been commercially successful, there is a desire to reduce the amount of plastic used in the manufacture of the container without sacrificing performance, to enhance ergonomic handling attributes, and to resist unwanted deformations in handling.

OBJECTIONS OF THE INVENTION

With the foregoing in mind, an object of the present invention is to provide a light-weight hot-fillable blow-molded grip container which functions at least as well as the aforementioned Graham Packaging grip containers.

Another object of the present invention is to provide a lightweight hot-fillable blow-molded plastic container having enhanced ergonomic handling qualities.

Another object of the present invention is to provide a user-friendly, hot-fillable blow-molded plastic grip container that is sufficiently robust as to resist deformations that may occur in handling of the container during manufacture and after hot filling and capping.

SUMMARY OF THE INVENTION

More specifically, the present invention provides a hot-fillable blow-molded plastic container having a sidewall with opposed label panels and intermediate panels each having a separate grip portion and a separate vacuum absorption portion. The grip portion has a wall portion inset into the container and extending chordally thereof to provide surfaces engageable by a user's finger and thumb when gripping the container. The grip wall portion is rigid to resist deflection when gripped and to resist flexure in response to normal vacuum conditions induced in the container in response to hot-fill processing. A vacuum absorption wall portion is located adjacent the grip wall portion and is separated therefrom by a rigid rib which extends between the label panels to rigidly interconnect them. Preferably, the grip portion is located superadjacent the vacuum absorption wall portion. Substantially the entire region between the label panels and the rib is occupied by the vacuum absorption wall portion. In one preferred embodiment, a smooth wall of a particular construction provides the entire vacuum absorption function. In another embodiment, a pair of vertically elongate vacuum panels separated by a post are provided to accommodate the requisite vacuum absorption. The rib that divides each intermediate panel into complementary configurations preferably extends diagonally thereacross, and is arcuate and of substantially the same radius of curvature as the label panels in order to provide a peripheral bumper between the label panels.

BRIEF DESCRIPTION OF THE DRAWING

The foregoing and other objects, features and advantages of the present invention should become apparent from the following description when taken in conjunction with the accompanying drawings, in which.

DETAILED DESCRIPTION OF THE PREFERRED EMBODIMENTS

Figure 1:
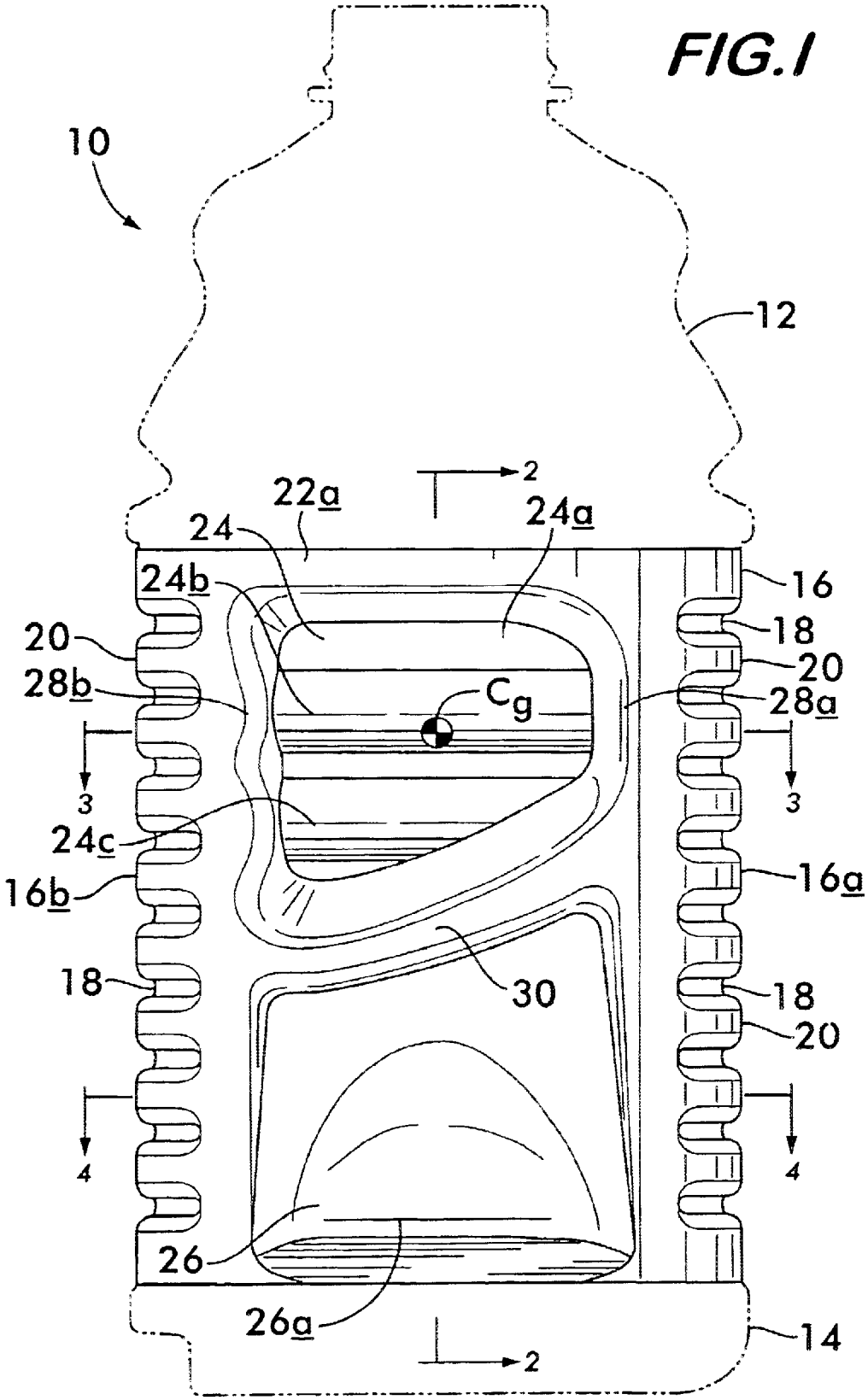
FIG. 1 is a side elevational view of one preferred embodiment of the present invention.
Figure 2:
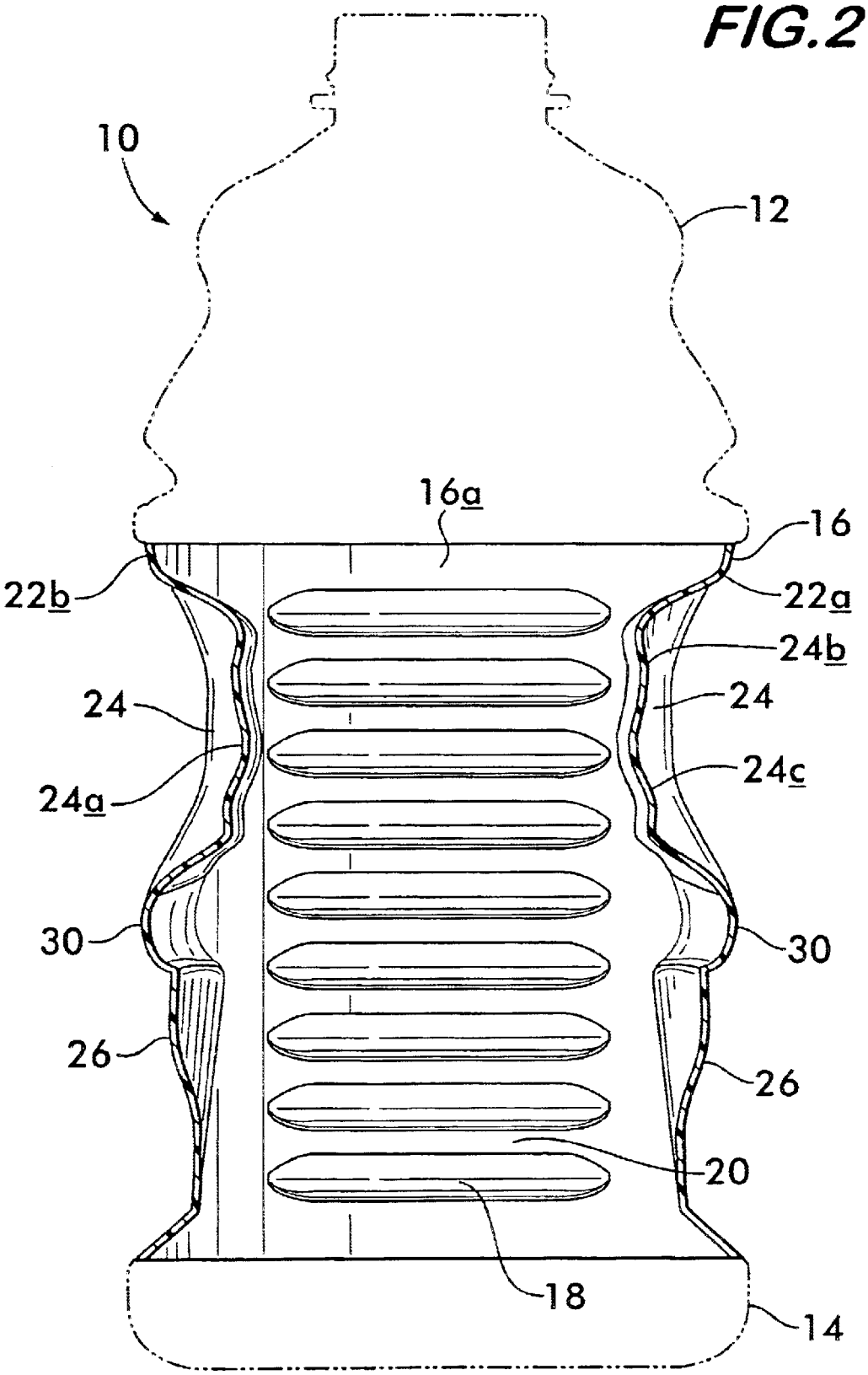
FIG. 2 is a longitudinal sectional view taken on Line 2—2 of FIG. 1.

Referring now to the drawings, FIG. 1 illustrates one preferred embodiment of a container 10 embodying the present invention. The container 10 has a conventional dome 12 and base 14, both shown in phantom, and a sidewall 16 between the dome and base, shown in full. The sidewall 16 has opposed label panels 16*a* and 16*b* reinforced by a series of horizontally disposed grooves 18 and ribs 20 of conventional construction. The sidewall 16 has opposed intermediate panels 22*a* and 22*b* extending between the label panels 16*a* and 16*b*, the front one of which is indicated at 16*a*, and the rear one which is indicated at 16*b*. The intermediate panel 22*a* has a separate rigid grip portion 24 and separate flexible vacuum absorption portion 26. The intermediate panel 22*b* is of like construction and is disposed diametrically opposite the panel 22*a* shown in FIG. 1. See FIGS. 3 and 4, The grip portion 24 has a generally planar wall portion 24*a* which is inset into the container 10 from its generally cylindrical shape, and which extends chordally to provide opposed surfaces engageable by a user's fingers and thumb when gripping the container by placing the thumb in the obverse grip shown in FIG. 1 and the fingers in the reverse grip on the other side of the container 10. The grip portion 24 has a pair of vertically spaced horizontally extending undulations 24*b*, 24*c* that rigidify the grip wall portion 24 and also provide an anti-slip function. The grip wall portion 24 is thereby formed to be rigid to resist deflection when gripped and to resist flexure in response to normal vacuum conditions induced in the container in response to hot filling, capping and cooling of the container contents.

Figure 3:
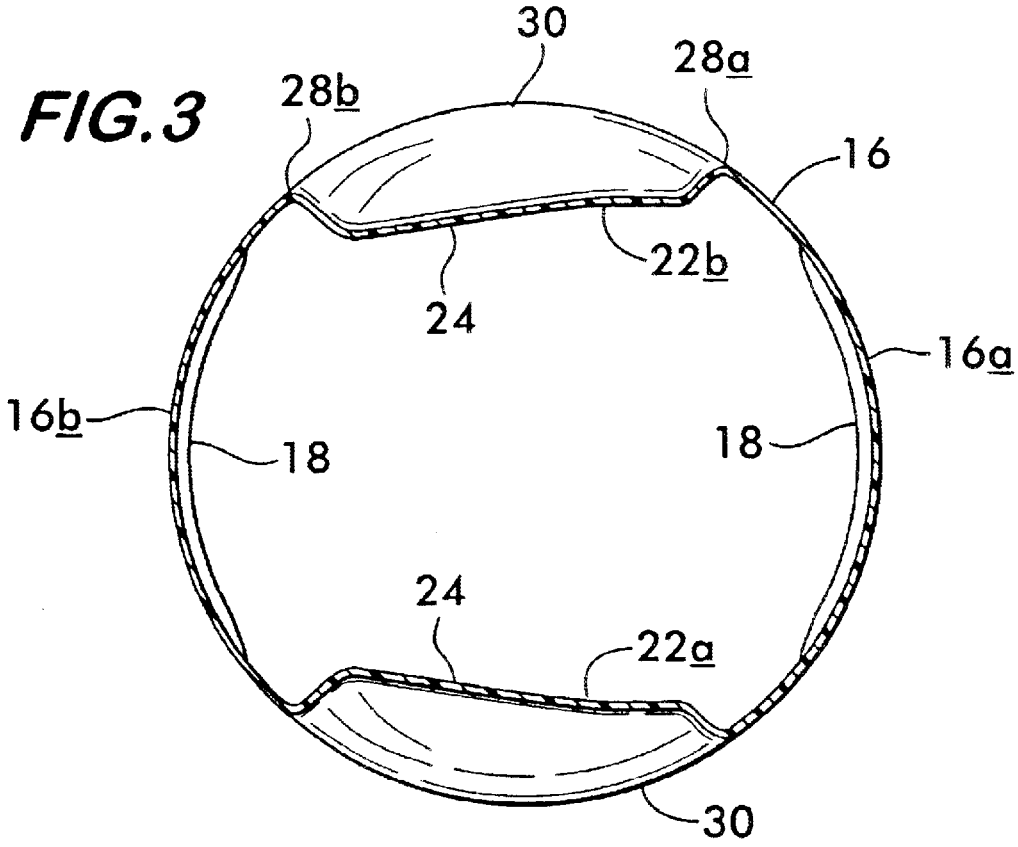
FIG. 3 is a transverse sectional view taken on Line 3—3 of FIG. 1.
Figure 4:
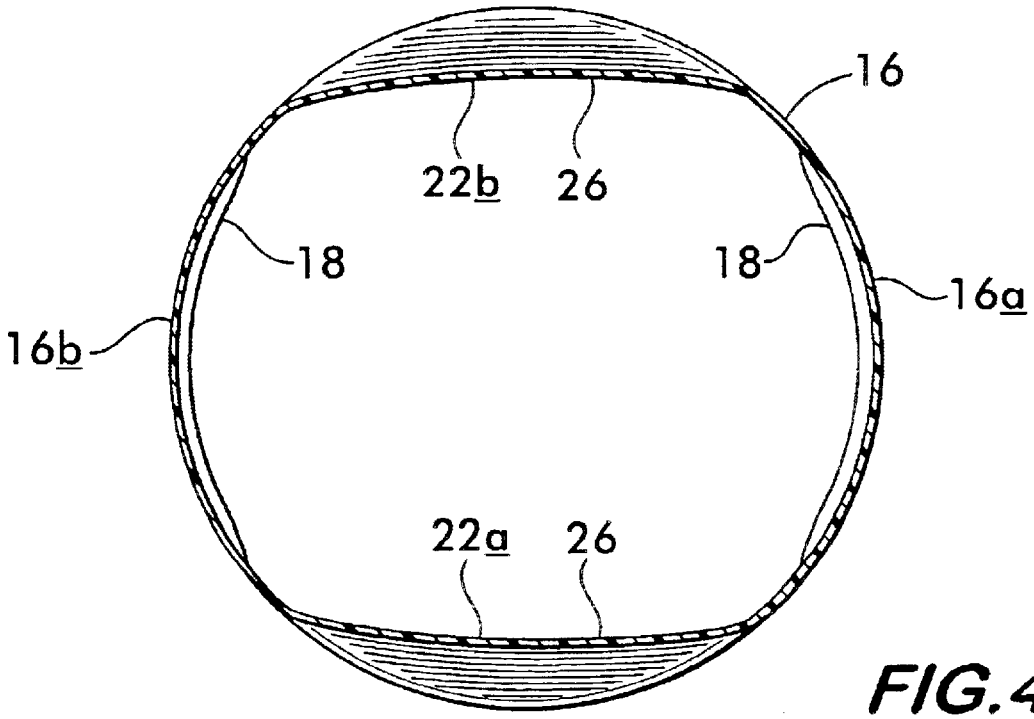
FIG. 4 is a transverse sectional view taken on Line 4—4 of FIG. 1.

The grip portion 24 is of a generally irregular trapezoidal shape, having a base 28*a* located adjacent the rear label panel 16*b* and a frustum 28*b* located adjacent the front label panel 16*a*. As best seen in FIG. 3, the front and rear label panels have the same radius of curvature to provide the container with a generally circular transverse cross section, although the invention has applicability to containers having generally rectangular or square transverse cross sectional configurations.

Preferably, the grip wall portion 24 is located in proximity with the filled container center of gravity Cg. The configuration of the grip is such as to provide a target for the user to grip the container at an ergonomically desirable location for pouring from the container when filled.

As best seen in FIG. 1, each intermediate panel 22*a* has a separate vacuum absorption wall portion 26 located immediately below the grip wall portion 24. The grip wall portion 24 and vacuum absorption wall portion 26 are separated by a rigid rib 30 which extends between the front and rear label panels 16*a*, 16*b* for rigidly connecting the label panels for providing flexure resistance.

The separate vacuum absorption wall panel 26 is located subjacent the grip wall portion 24. The vacuum absorption wall portion 26 and grip wall portion 24 are thereby vertically aligned in the intermediate panels 22*a*, 22*b*, and the vacuum absorption panel 26 occupies substantially the entire space between the front and rear label panels 16*a*, 16*b*, the rib 30, and the base 14 of the container 10. The vacuum absorption wall panel 26 is designed and sized to provide substantially all of the normal hot-filled vacuum absorption required of the container sidewall.

A preferred form of vacuum absorption wall construction is disclosed in PCT application published on 31 Aug. 2000 under publication No. WO 00/50309 filed in the name of David Melrose of Auckland, New Zealand. In the present invention the preferred vacuum absorption wall panel has an initiator section 26*a* for causing the wall portion to deflect inwardly in a controlled manner in response to vacuum induced inside the container as a result of filling, capping, and cooling. For a more complete description of the structure and function of a preferred vacuum absorption panel, reference is made to the aforementioned published PCT application, the disclosure which is incorporated by reference herein.

In the embodiment of FIGS. 1–4, the rib 30 extends diagonally across the intermediate panel and has a radius of curvature corresponding substantially to the front and rear label panels 16*a*, 16*b* to provide a robust lateral bumper that aids in preventing the container from being deformed in the course of handling during manufacture, filling and shipment to the ultimate consumer.

Figure 5:
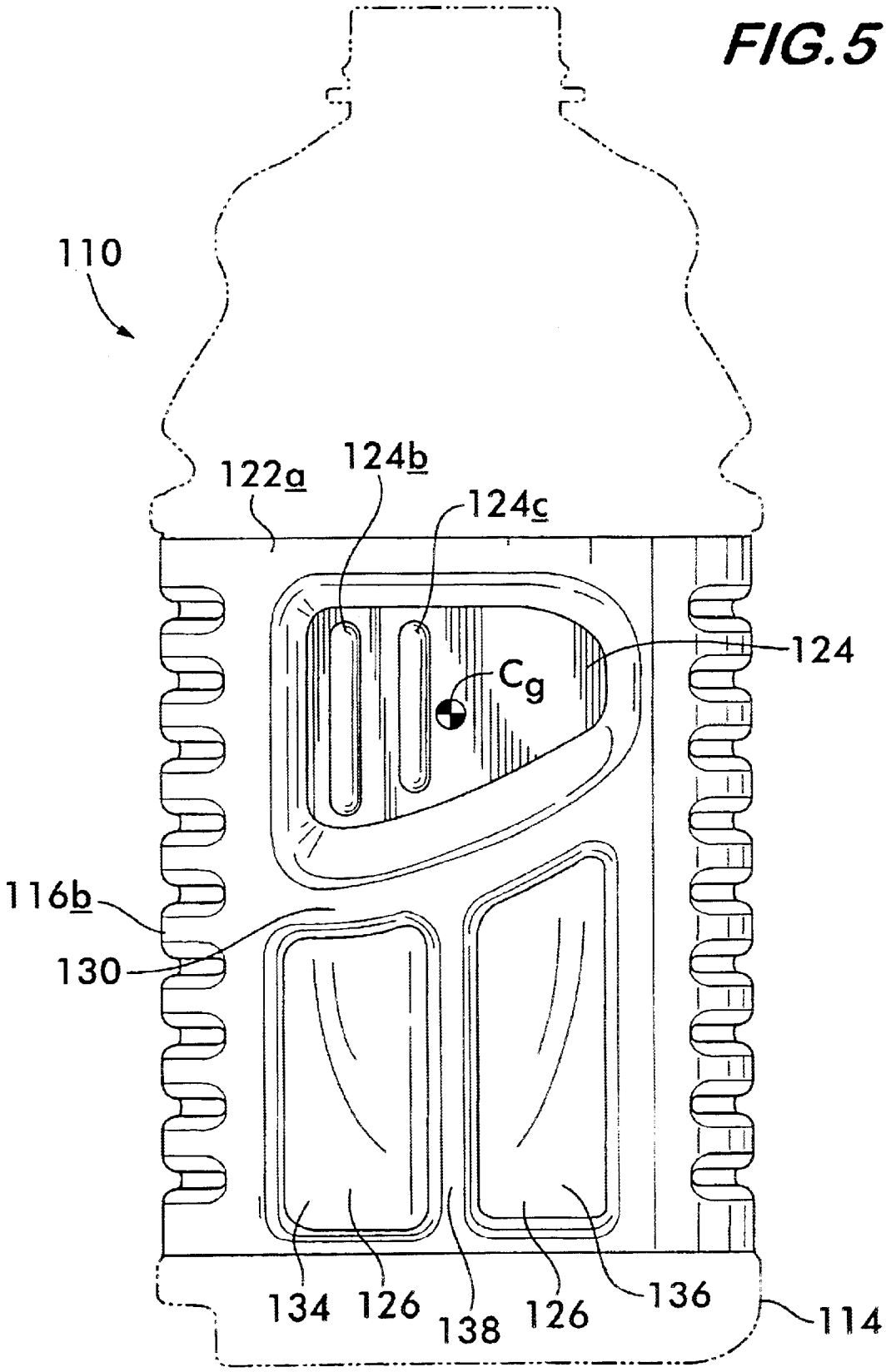
FIG. 5 is a side elevational view of another preferred embodiment of the present invention.

Turning now to FIG. 5, another preferred embodiment 110 is provided utilizing the same general overall configuration as the aforementioned embodiment, but with some differences. For instance, the inset grip wall portion 124 has a pair of horizontally spaced, vertically elongated anti-slip ribs 124*b*, 124*c* extending outwardly in spaced parallel relation adjacent to the rear label panel 116*b*. The vacuum absorption wall portion 126 below the grip includes a pair of vertically elongate flex panels 134, 136 which may be of conventional construction, or which may be in accordance with the teachings of the aforementioned PCT published application. The flex panels 134,136 extend vertically in spaced parallel relation subjacent the grip wall portion 124. The flex panels 134, 136 are separated horizontally by a post 138 which extends vertically between and interconnects the rib 130 and container base 114. The pair of flex panels are disposed in an arcuate array extending generally peripherally in substantial alignment with the arc of the rib and label panels. These vacuum absorption wall portions function to accommodate vacuum induced inside the container in response to hot filling, capping and cooling of the container contents.

In both of the preferred embodiments, the center of gravity of the filled container is located in the region indicated generally at Cg in FIGS. 1 and 5. Both embodiments are designed to have a nominal filled capacity of 64 fluid ounces. The containers are designed to be filled hot, ie. at a temperature of at least about 185° F.

By way of example, the comparison with a Graham patented grip container, such as disclosed in the aforementioned Graham patents, the container of the embodiment depicted in FIGS. 1–4 made of PET plastic weighs 75 grams, or less; whereas, the patented Graham container in production weighs 81 grams, or more.

The containers are ergonomically friendly because the rigid grip wall portions are located at a desirable targeted lifting location and do not deflect in response to normal gripping pressure applied when lifting and pouring from a filled container. The rigidity enables all of the sidewall required vacuum accommodation to be accepted by the subjacent flexible vacuum absorption wall portions.

While preferred embodiments of the present invention have been described in detail, various modifications, alterations and changes may be made without departing from the spirit and scope of the present invention as defined in the appended claims.

What is claimed is:

1. In a hot-fill blow-molded container (10, 110) having a sidewall (16) with opposed label panels (16*a*, 16*b*) and opposed intermediate panels (22*a*, 22*b*) connecting the label panels (16*a*, 16*b*) for affording gripping of the container (10, 110) and pouring contents therefrom, the improvement wherein each intermediate panel (22*a*, 22*b*) has a separate grip portion (24, 124) and a separate vacuum absorption portion (26, 126), said grip portion (24, 124) having a wall portion (24*a*) inset into the container (10, 110) and extending chordally thereof for providing opposed surfaces engageable by a user's fingers and thumb when gripping the container (10, 110), said grip wall portion (24*a*) being rigid and having a periphery and at least one reinforcing structure disposed within said periphery to enable said grip wall portion (24*a*) to resist deflection when gripped and to resist flexure in response to normal vacuum conditions induced in the container (10, 110) in response to hot filling, capping and cooling of the container contents, said separate vacuum absorption wall portion (26, 126) being located adjacent to said grip wall portion (24, 124) and being separated therefrom by a rigid rib (30, 130) extending diagonally between said label panels (16*a*, 16*b*) for rigidly connecting together the label panels (16*a*, 16*b*) intermediate the grip and flex portions (24, 26, 124, 126) and providing a sidewall bumper that resists flexure, and said separate vacuum absorption portions (26, 126) of both intermediate panels (22*a*, 22*b*) cooperating to provide a substantial portion of the normal hot-fill vacuum absorption required of the container sidewall (16).

2. The container (10) according to claim 1 wherein said grip wall panel (24) is located superadjacent said vacuum absorption wall portion (26) in said intermediate wall (22*a*, 22*b*).

3. The container (10) according to claim 2 wherein said grip wall portion (24) is located in proximity with the filled container center of gravity (Cg).

4. The container (10) according to claim 3 wherein said at least one reinforcing structure disposed within said periphery of said grip wall portion (24) includes a plurality of anti-slip protrusions (24*b*, 24*c*).

5. The container (10) according to claim 1, wherein said rib (30) is of substantially the same radius of curvature as said opposed label panels (16*a*, 16*b*) to provide a peripheral bumper.

6. The container (10, 110) according to claim 1, wherein said vacuum wall portion (26, 126) is located subjacent said grip wall portion (24, 124).

7. The container (10) according to claim 6 wherein said vacuum wall portion (26) occupies substantially the entire region of said intermediate panel (22*a*, 22*b*) below said rib (30) and between said label panels (16*a*, 16*b*).

8. The container (10) according to claim 6 wherein said rib (30) connects said label panels (16*a*, 16*b*) and is of substantially the same radius of curvature to provide an arcuate bumper.

9. A container according to claim 1, wherein the container has a nominal filled capacity of 64 fluid ounces and an empty weight that does not exceed 75 grams.

10. In a hot-fill blow-molded container (110) having a sidewall (16) with opposed label panels (16*a*, 16*b*) and opposed intermediate panels (122*a*, 22*b*) connecting the label panels (16*a*, 16*b*) for affording gripping of the container (110) and pouring contents therefrom, the improvement wherein each intermediate panel (22*a*, 22*b*) has a separate grip portion (124) and a separate vacuum absorption portion (126), said grip portion (124) having a wall portion (24*a*) insert into the container (110) and extending chordally thereof for providing opposed surfaces engageable by a user's fingers and thumb when gripping the container (110).

said grip wall portion (24*a*) being rigid and having a periphery and at least one reinforcing structure disposed within said periphery to enable said grip wall portion (24*a*) to resist deflection when gripped and to resist flexure in response to normal vacuum conditions induced in the container (110) in response to hot filling, capping and cooling of the container contents, said separate vacuum absorption wall portion (126) being located subjacent said grip wall portion (124) and being separated therefrom by a rigid rib (130) extending between said label panels (16*a*, 16*b*) for rigid connecting together the label panels (16*a*, 16*b*) intermediate the grip and flex portions (124, 126) and providing a sidewall bumper that resists flexure, and said separate vacuum absorption portions (126) of both intermediate panel (22*a*, 22*b*) cooperating to provide a substantial portion of the normal hot-fill vacuum absorption required of the container sidewall (16), said vacuum wall portion (126) including a plurality of elongate flex panels (134, 136), and at least one post (138) extending between said elongate flex panels (134, 136).

11. The container (110) according to claim 10 wherein said elongate flex panels (134, 136) and post (138) are disposed vertically.

12. The container (110) according to claim 10 wherein said rib (130) is arcuate and of substantially the same radius of curvature as said label panels, and said flex panels (134, 136) are disposed in an arcuate array extending generally peripherally in substantial alignment with said rib (130) and said label panels.

13. In a hot-fill blow-molded container (10) having a base (14) and a sidewall (16) with opposed label panels (16*a*, 16*b*) and opposed intermediate panels (22*a*, 22*b*) connecting the label panels (16*a*, 16*b*) for affording gripping of the container (10) and pouring contents therefrom, the improvement wherein:

each intermediate panel (22*a*, 22*b*) has a separate grip portion (24) and a separate vacuum absorption portion (26) located vertically adjacent one another, said grip portion (24) having a wall portion (24*a*) inset into the container (10) and extending chordally thereof in proximity with the filled center of gravity (Cg) of the container (10) for providing opposed surfaces engageable by a user's fingers and thumb when gripping the container (10), said grip wall portion (24) being rigid and having a periphery and at least one reinforcing structure disposed within said periphery to enable said grip wall portion (24*a*) to resist deflection when gripped and to resist flexure in response to normal vacuum conditions induced in the container (10) in response to hot filling, capping and cooling of the container contents.

said separate vacuum absorption wall portion (26) being separated therefrom by a rigid rib (30) extending arcuately between said label panels (16*a*, 16*b*) for rigidly connecting together the label panels (16*a*, 16*b*) intermediate the grip and flex portions (24, 26) and providing a sidewall bumper that resists flexure, said rigid rib (30) being disposed diagonally across said intermediate panel (22*a*, 22*b*) said vacuum absorption wall portion (26) occupying substantially the entire space between said label panels (16*a*, 16*b*), said rib (30) and said base (14), and said separate vacuum absorption wall portion (26) of both intermediate panels (22*a*, 22*b*) cooperating to provide substantially all of the normal hot-fill vacuum accommodation required of the container sidewall (16).

14. The container (10) according to claim 13 wherein said grip portion (24) is located above said vacuum absorption portion (26).

15. A container according to claim 13, wherein the container has a nominal filled capacity of 64 fluid ounces and an empty weight that does not exceed 75 grams.

* * * * *

UNITED STATES PATENT AND TRADEMARK OFFICE

CERTIFICATE OF CORRECTION

PATENT NO. : 6,796,450 B2
APPLICATION NO. : 10/182165
DATED : September 28, 2004
INVENTOR(S) : Roger M. Prevot et al.

It is certified that error appears in the above-identified patent and that said Letters Patent is hereby corrected as shown below:

Title Page; should read and insert;

--(*) Notice: Subject to any disclaimer, the term of this patent is extended or adjusted under 35 U.S.C. 154(b) by 14 days.

(22) PCT Filed: October 17, 2001

(86) PCT No.: PCT/US01/32217
§ 371 (c)(1), (2), (4) Date: July 25, 2002

(87) PCT Pub. No.: WO00/50399
PCT Pub. Date: August, 2000

Related U.S. Application Data

(60) Provisional application No. 60/241,734, filed on Oct. 19, 2000.--

Signed and Sealed this

Fourth Day of May, 2010

David J. Kappos

David J. Kappos
*Director of the United States Patent and Trademark Office*